US005142737A

United States Patent [19]

Ferrari et al.

[11] Patent Number: 5,142,737

[45] Date of Patent: Sep. 1, 1992

[54] BASE WITH ADJUSTABLE ELEMENTS FOR A HINGE WING

[75] Inventors: Franco Ferrari, Frazione Deviscio, 2 - 22053 Lecco, Como; Carlo Migli, Lecco, both of Italy

[73] Assignee: Franco Ferrari, Lecco, Italy

[21] Appl. No.: 698,160

[22] Filed: May 9, 1991

[30] Foreign Application Priority Data

May 11, 1990 [IT] Italy ..... 21161/90[U]

[51] Int. Cl.[5] ..... E05D 11/10

[52] U.S. Cl. ..... 16/235; 16/DIG. 43

[58] Field of Search ..... 16/235, 247, 248, 249, 16/239, 240, 241, 243, 244, 245, 236, 237, 250, DIG. 43

[56] References Cited

U.S. PATENT DOCUMENTS 4,142,271 3/1979 Busse ..... 16/248
4,227,284 10/1980 Zernig ..... 16/249
4,873,743 10/1989 Toyama ..... 16/249
5,025,530 6/1991 Ferrari et al. ..... 16/240

FOREIGN PATENT DOCUMENTS 0346633 12/1989 European Pat. Off. ..... 16/235

*Primary Examiner*—Lowell A. Larson
*Assistant Examiner*—Michael J. McKeon
*Attorney, Agent, or Firm*—Finnegan, Henderson, Farabow, Garrett & Dunner

[57] ABSTRACT

A base (10) comprises a first plate type element (11) to be secured to the piece of furniture and a second element (12) shaped to fit onto a hinge wing (13). The plate element (11) is generically shaped in the form of a cross with countersunk holes (14, 15) for screwing it onto the piece of furniture. Disposed between the holes is a seat (17) into which the second element (12) is screwed. The lower part of the second element (12) has a housing (19) into which the first element (11) fits with uniform transverse clearance, thereby advantageously enabling adjustment of the transversal position of the second element (12).

4 Claims, 2 Drawing Sheets

BASE WITH ADJUSTABLE ELEMENTS FOR A HINGE WING

BACKGROUND OF THE INVENTION

In the known technique of furniture hinges there are bases which are secured to the piece of furniture and onto which the wing of a hinge is subsequently coupled, for example by snapping into place.

There are bases, such as the one described for example in the Italian Utility model patent application No. 20408 B/89 on behalf of the same Applicant, that are made with a first part which is firmly secured, for example by means of screws, to the piece of furniture and a second part which is secured to the first part and onto which the wing of the hinge is coupled.

Whenever the hinges are fitted automatically the holes for the screws to secure them to the piece of furniture are drilled automatically by machine and are therefore always accurately positioned.

For substantially aesthetical reasons, it is preferred to have a second part which, once in place, completely covers the first part so as to conceal the fastening screws.

It has been noted, however, that whenever the hinges are fitted by hand it is usually preferable for the screws to be in an easily reachable position even when the two parts of the base have been assembled, in order to be able to mark the position of the holes with the hinge completely assembled, so as to know exactly where to drill them.

Producing two different types of hinges to satisfy these two opposing requirements, however, entails problems and manufacturing and storage costs which are easily imaginable.

SUMMARY OF THE INVENTION

The general scope of this invention is to obviate the aforementioned problems by providing a base in two parts for securing wing-type hinges, which enables the hinge to be fitted to the piece of furniture with the screw holes either concealed or visible according to the requirements of the user.

This scope is achieved according to the invention by providing a base of the type having coupling surfaces for a wing of a furniture hinge onto which it can be fitted, characterized by the fact of comprising a first element provided from above with said coupling surfaces and from below with a recessed housing shaped to receive a second element having a through hole at each end for screws to secure it to the piece of furniture,, the first element centrally comprising a through hole for the shank of a screw for securing the first element to the second element, said second element being rotatable from a first position lengthwise to the extension of the hinge in which it fits completely into said housing, to a second position, at 90° with respect to the first position, in which the ends bearing the through holes protrude from the sides of said first element.

BRIEF DESCRIPTION OF THE DRAWING

The innovative principles of this invention and its advantages with respect to the known technique will be more clearly evident from the following description of a possible exemplificative and non-restrictive embodiment applying such principles, with reference to the accompanying drawings, in which.

DESCRIPTION OF THE PREFERRED EMBODIMENT

Figure 1:
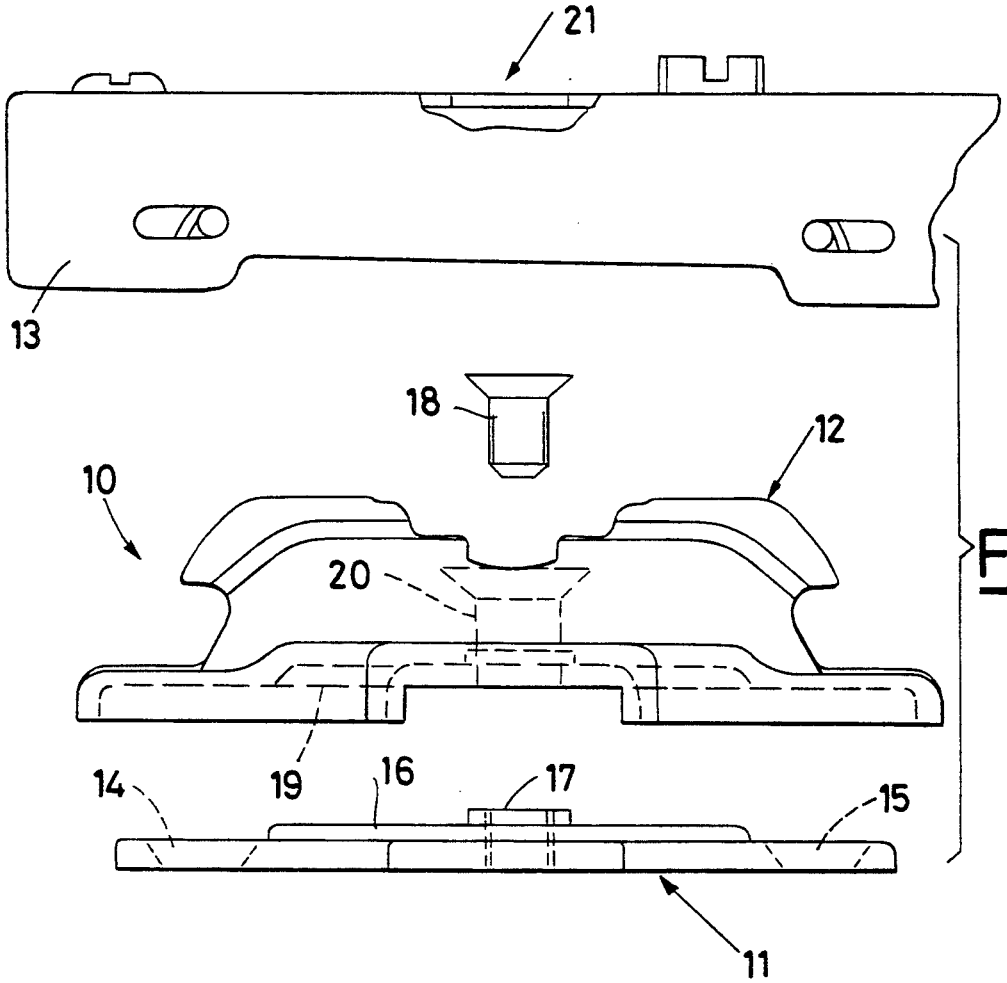
FIG. 1 shows an exploded side view of a hinge with a base applying the principles of this invention.

With reference to the figures, as shown in FIG. 1, a base made according to the invention and generally indicated by reference 10, comprises a first plate element 11 to be secured to the piece of furniture and a second element 12 shaped to couple with, for example by snapping onto, an elongated articulated wing 13, which wing is partially shown since it is of known technique and therefore easily imaginable by any technician. The wing can be for example of the type provided with height and position adjustment. For example, the upper portion of the element 12 and the articulated wing 13, with their reciprocal coupling, can be of the type described in the Italian utility model patent application No. 22155 B/88 on behalf of the same Applicant.

Figure 2:
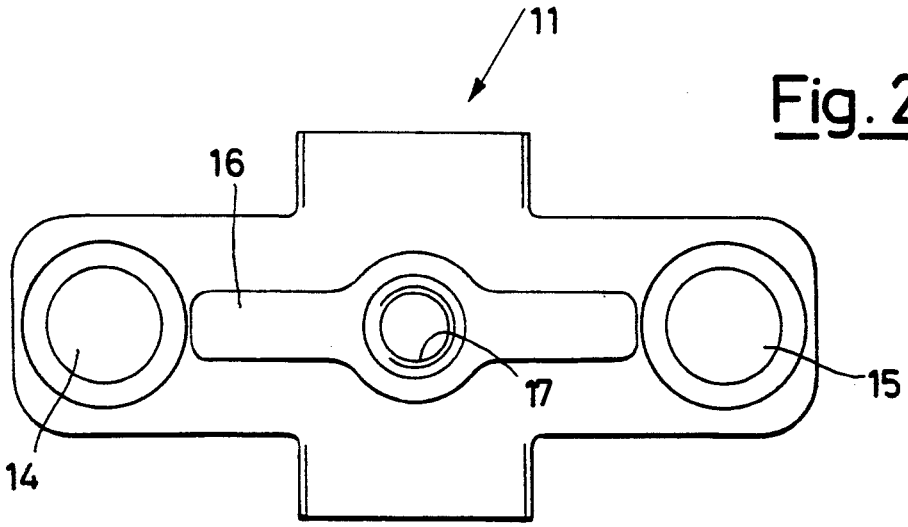
FIG. 2 shows a plan view of one part of the base of FIG. 1.

The plate element 11 (as can be more clearly seen in FIG. 2) is substantially cross-shaped with two countersunk holes 14 and 15 at the ends of the longer arms of the cross. Disposed between the two holes, and protruding from the upperside of the plate 11, is a strengthening rib 16 centrally provided with a screw hole 17 for a screw 18.

The coupling element 12 is provided from below, as shown by the broken line in FIGS. 1, 3 and 4, with a housing 19, also shaped substantially in the form of a cross, to receive the plate with side play. The cross-shaped housing 19 has its longer arms parallel to the extension of the hinge and its shorter arms opening crosswise to the base (as can be clearly seen in FIG. 1).

Moreover, the coupling element 12 has a vertical hole 20, extending through to the base, for passage of the shank of the screw 18.

Figure 3:
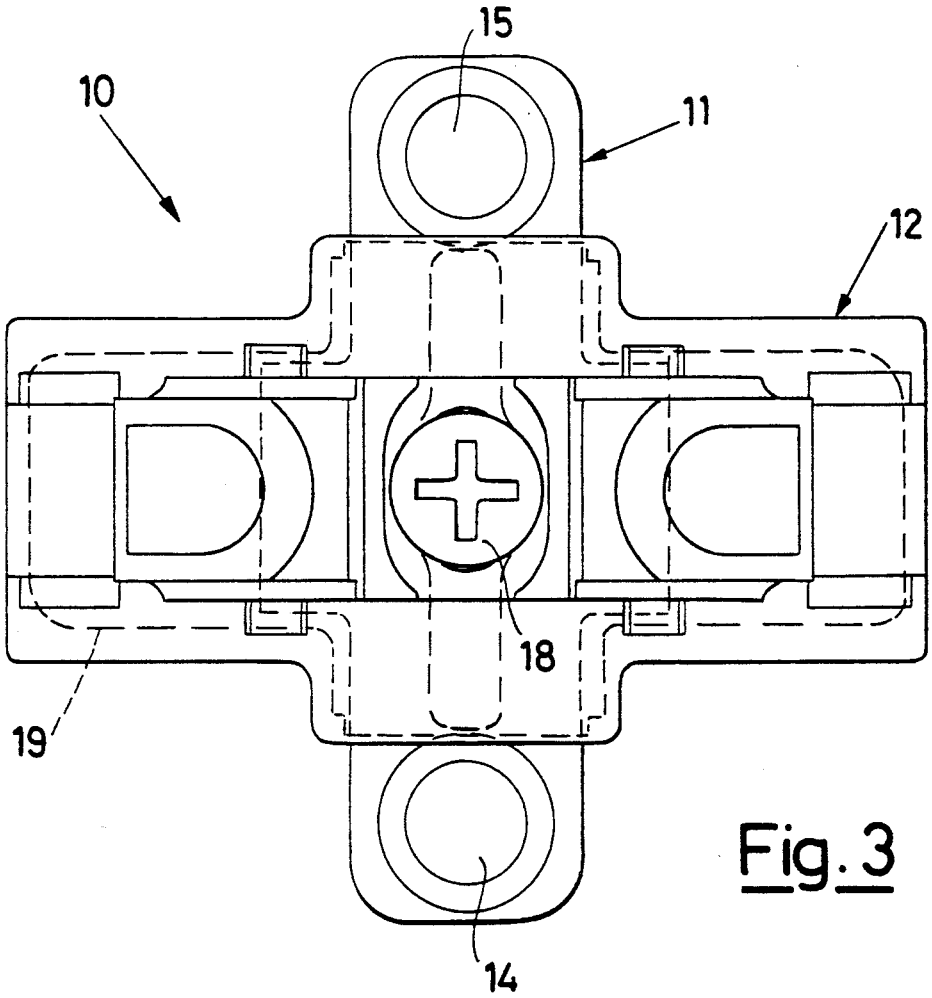
FIG. 3 shows a plan view of the base of FIG. 1 in a first fitting condition.
Figure 4:
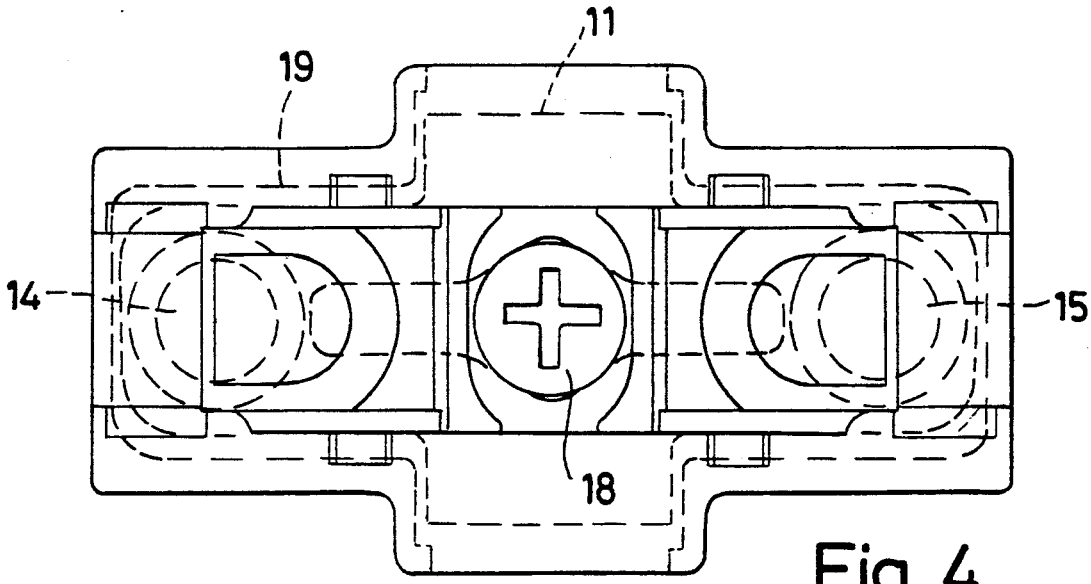
FIG. 4 shows a plan view of the base of FIG. 1 in a second fitting condition.

As shown in FIGS. 3 and 4, the plate element 11 and the lower housing 19 are reciprocally sized to enable the plate element 11 and coupling element 12 to be fitted either with an orthogonal disposition (FIG. 3) or with a parallel disposition (FIG. 4). In the former case, the longer arms of the plate 11 protrude from the sides of the base so as to give access to the holes 14 and 15 even when the hinge is assembled. In the latter case, the plate 11 fits completely inside the housing 19 and the holes 14 and 15 are only accessible when the element 12 is removed. The hole 20 being elongated in the direction crosswise to the elongation direction of wing 13, when coupled, advantageously enables the screw 18 to slide laterally so that the position of the plate 11 can also be adjusted crosswise to the hinge with respect to the element 12 by simply loosening the screw 18. For this purpose, the wing 13 can be provided form above with a control passage 21 for the screw 18, so as to be able to carry out the adjustment when the hinge is fully assembled.

It is clear at this point that the intended objects of the invention have been achieved. By loosening or completely unscrewing the screw 18 and rotating the plate 11 by 90°, the same base 10 can be used with the fastening holes visible (FIG. 3) or with the fastening holes concealed (FIG. 4).

The foregoing description of an embodiment applying the innovative principles of this invention is obviously given merely by way of example in order to illustrate such innovative principles and should not therefore be understood as a limitation to the scope of the invention claimed herein.

For example, the coupling system between the wing and coupling element can be of any known type, such as snap-on, sliding fit, screw-on, etc.

Moreover, the shape of the plate 11 and, consequently, the housing 19 can be different from those shown and not necessarily cross-shaped.

We claim:

1. A hinge base of the type having coupling surfaces for an elongated wing of a furniture hinge onto which it can be fitted, the base comprising a first element having an upper part provided with said coupling surfaces and a lower part having a recessed housing; a second element being elongated and having a securing through hole at each end adapted to receive screws to secure it to a piece of furniture, the first element including a centrally disposed connecting through hole for the shank of a screw for securing the first element to the second element, said recessed housing being shaped to receive said elongated second element in at least first and second positions relatively angularly spaced by 90° about said connecting through hole axis, said first element being configured to cover the ends and the securing through holes of said second member when said second member is disposed in said first receiving position in said recessed housing, and to expose the ends and the securing through holes of said second member when said second member is disposed in said second receiving position in said recessed housing.

2. The hinge base as claimed in claim 1, wherein said recessed housing is shaped to enable adjustment of the relative positions of the first and second elements in a plane perpendicular to the connecting through hole axis when said second member is disposed in said recessed housing, and wherein the connecting through hole is elongated in a direction crosswise to the elongation direction of the hinge wing when coupled.

3. The hinge base as claimed in claim 1, wherein said recessed housing is shaped in the form of a straight cross with recess arms disposed lengthwise and crosswise respectively to the elongation direction of the hinge wing when coupled, the crosswise recess arms being open at the ends on lateral opposing sides of the first element, to enable the passage of the second element when it is disposed in said second receiving position.

4. The hinge base as claimed in claim 3, wherein the second element is shaped in the form of a straight cross having a first pair of opposing arms bearing the securing through holes and a second pair of opposing arms shorter in length than said first opposing arms.

* * * * *